US011161033B1

(12) United States Patent
Rothert

(10) Patent No.: US 11,161,033 B1
(45) Date of Patent: Nov. 2, 2021

(54) TILING PUZZLE

(71) Applicant: Chad H. Rothert, Matthews, NC (US)

(72) Inventor: Chad H. Rothert, Matthews, NC (US)

( * ) Notice: Subject to any disclaimer, the term of this patent is extended or adjusted under 35 U.S.C. 154(b) by 8 days.

(21) Appl. No.: 16/807,507

(22) Filed: Mar. 3, 2020

Related U.S. Application Data

(60) Provisional application No. 62/814,548, filed on Mar. 6, 2019.

(51) Int. Cl.
*A63F 9/06* (2006.01)

(52) U.S. Cl.
CPC .... *A63F 9/0669* (2013.01); *A63F 2009/0697* (2013.01)

(58) Field of Classification Search
CPC ... A63F 9/0669; A63F 2009/0697; A63F 9/10
See application file for complete search history.

(56) References Cited

U.S. PATENT DOCUMENTS 5,149,098 A * 9/1992 Bianchi ..... A63F 9/10 273/157 R
5,407,201 A * 4/1995 Whitehurst ..... A63F 9/12 273/153 P
5,497,991 A * 3/1996 Huang ..... A63F 3/00097 273/157 R
6,098,980 A * 8/2000 Ramage ..... A63F 9/1044 273/157 R
2010/0194040 A1* 8/2010 Wood ..... A63F 9/08 273/156

* cited by examiner

*Primary Examiner* — Michael D Dennis
(74) *Attorney, Agent, or Firm* — Schwartz Law Firm, P.C.

(57) ABSTRACT

A tiling puzzle includes a low-profile packing frame having a raised continuous border and a flat recessed surface area within the border. A plurality of multi-sided puzzle pieces are adapted for being assembled together on the recessed surface area of the packing frame. A frame indicium is located on the packing frame. A multi-sided solution key is adapted for residing within the recessed surface area of the packing frame directly adjacent the frame indicium. After properly placing the solution key within the packing frame, the puzzle is solved by assembling the puzzle pieces together on the recessed surface area in a single functional arrangement such that the solution key and all puzzle pieces occupy the entire recessed surface area within the packing frame without gaps or overlaps.

7 Claims, 3 Drawing Sheets

TILING PUZZLE

TECHNICAL FIELD AND BACKGROUND OF THE DISCLOSURE

The present disclosure relates broadly and generally to a tiling puzzle. In exemplary embodiments, the present invention may be used as a fun single player or cooperative multi-player game at a social event to make a surprise public announcement, such as a gender reveal.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a tiling puzzle. The puzzle includes a low-profile packing frame having a raised continuous border and a flat recessed (continuous) surface area within the border. A plurality of multi-sided puzzle pieces are adapted for being assembled together on the recessed surface area of the packing frame. A frame indicium is located on the packing frame; e.g., on the border outside of the recessed surface area or at any point within the recessed surface area. A multi-sided solution key is adapted for residing within the recessed surface area of the packing frame directly adjacent the frame indicium. After properly placing the solution key within the packing frame, the puzzle is solved by assembling the puzzle pieces together on the recessed surface area in a single functional arrangement. The term "single functional arrangement" means that the solution key and all puzzle pieces occupy the entire recessed surface area within the packing frame without gaps or overlaps.

According to one exemplary embodiment, the multi-sided solution key and each multi-sided puzzle piece is substantially flat. The term "substantially flat" is used herein to mean an object having two opposing major surfaces without regard to its relative thinness or thickness.

According to another exemplary embodiment, the frame indicium comprises a marking having a length corresponding to a length of a side of the solution key.

According to another exemplary embodiment, the frame indicium comprises a color.

According to another exemplary embodiment, a single side of the solution key comprises a color corresponding to the color of the frame indicium.

According to another exemplary embodiment, the plurality of puzzle pieces have respective opposing first and second major surfaces.

According to another exemplary embodiment, at least one of the first and second major surfaces of all puzzle pieces comprises a common color. In other words, for example, one major surface of all puzzle pieces may be colored blue. Alternatively, one major surface of all puzzle pieces may be colored pink.

According to another exemplary embodiment, in the single functional arrangement, the common color of all puzzle pieces faces up.

According to another exemplary embodiment, the common color is selected from a group consisting of pink and blue.

According to another exemplary embodiment, the first major surface of each puzzle piece comprises a color pink.

According to another exemplary embodiment, the second major surface of each puzzle piece comprises a color blue.

According to another exemplary embodiment, the packing frame is rectangular.

According to another exemplary embodiment, the raised continuous border is rectangular.

In another exemplary embodiment, the present disclosure comprises a tiling puzzle including a packing frame, a plurality of multi-sided puzzle pieces, and a multi-sided solution key. The packing frame has a raised continuous border and a flat recessed surface area within the border. The puzzle pieces are adapted for being assembled together on the recessed surface area of the packing frame. Each puzzle piece has opposing first and second major surfaces. First and second spaced apart frame indicia are located on the border of the packing frame outside of the recessed surface area. The solution key has opposing first and second major key surfaces, and a first key indicium located on the first major key surface and a second key indicium located on the second major key surface. The first key indicium corresponds to the first frame indicium and the second key indicium corresponds the second frame indicium. After properly placing the solution key within the packing frame, the puzzle is solved by assembling the puzzle pieces together on the recessed surface area in a single functional arrangement. The term "single function arrangement" means that the solution key and all puzzle pieces occupy the entire recessed surface area within the packing frame without gaps or overlaps.

According to another exemplary embodiment, the first and second frame indicia comprise respective markings, each marking having a length corresponding to a length of a side of the solution key.

According to another exemplary embodiment, the markings of the frame indicia comprise different first and second colors (e.g., red and green). In other words, for example, the first frame indicium may comprise a solid red marking and the second frame indicium may comprise a solid green marking.

According to another exemplary embodiment, the first key indicium is located adjacent a single side of the solution key and comprises a color corresponding to the first color of the frame indicium.

According to another exemplary embodiment, the second key indicium is located adjacent a single side of the solution key and comprises a color corresponding to the second color of the frame indicium.

In yet another exemplary embodiment, the present disclosure comprises a method using a tiling puzzle for revealing the gender of an unborn baby. The method includes positioning a multi-sided solution key of the tiling puzzle at one of a plurality of key points within a surface area of a packing frame. Each key point is identified by indicia on the packing frame. A plurality of multi-sided puzzle pieces of the tiling puzzle are then located within the surface area of the packing frame. The user attempts to solve the tiling puzzle by assembling the puzzle pieces together on the surface area of the packing frame in a single functional arrangement, wherein the solution key and all puzzle pieces occupy the entire surface area of the packing frame without gaps or overlaps. The solution key of the tiling puzzle is repositioned at alternative key points within the surface area of the packing frame and the puzzle pieces reassembled together until the single functional arrangement of the puzzle pieces is achieved.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
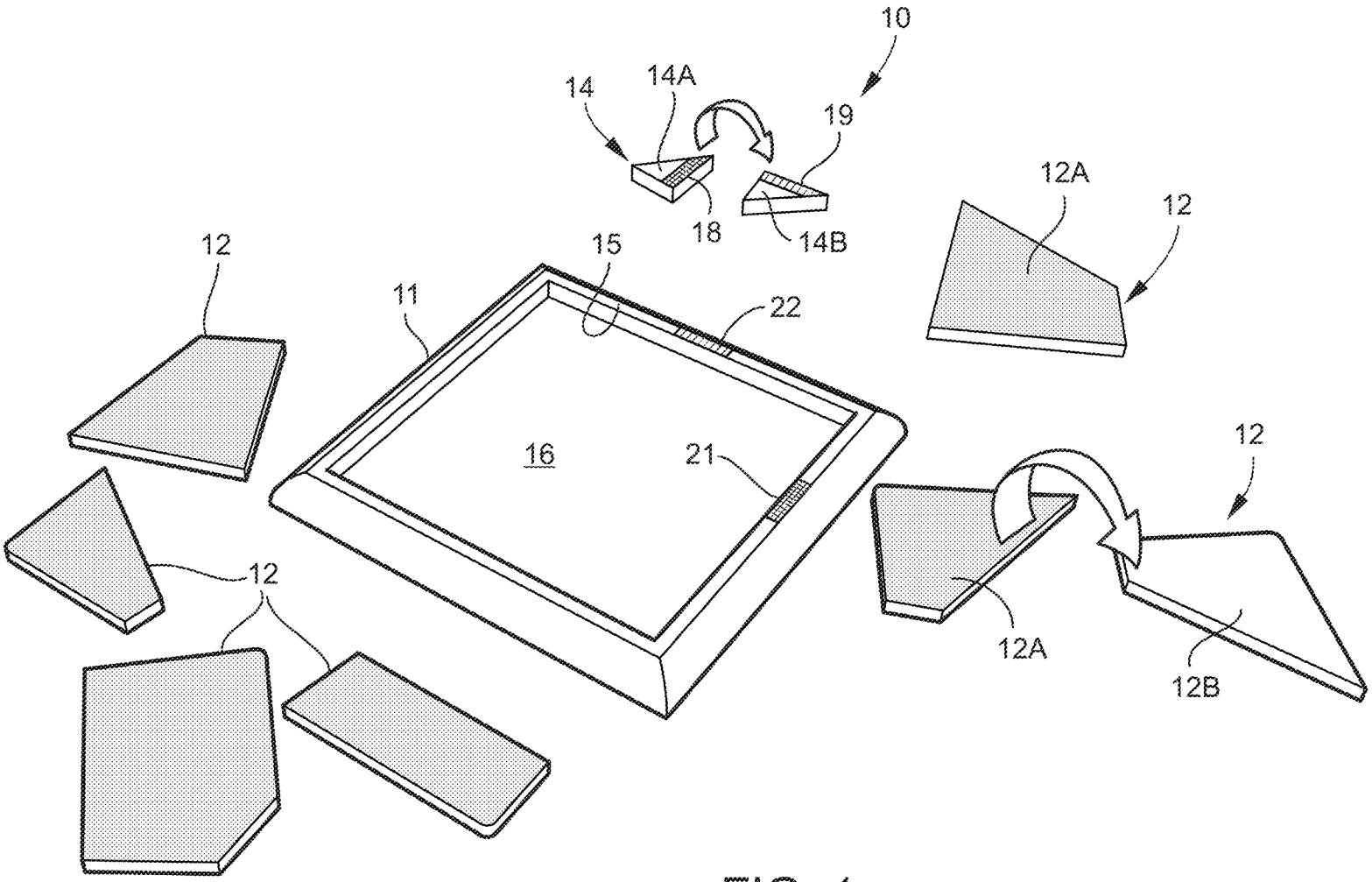
FIG. 1 is a perspective view illustrating various exemplary components of the present tiling puzzle.

Referring now specifically to the drawings, a tiling puzzle according to one exemplary embodiment of the present disclosure is illustrated in FIG. 1 and shown generally at broad reference numeral 10. The exemplary tiling puzzle 10 is intended to be solved by one or more players and may be used as a fun game at a social event to make a surprise public announcement, such as a gender reveal—an announcement by expectant parents of the sex of their unborn child.

In exemplary embodiments, the present tiling puzzle 10 includes a rectangular packing frame 11, a plurality of multi-sided puzzle pieces 12, and a multi-sided solution key 14. The packing frame 11 has a raised continuous rectangular border 15 and a flat recessed surface area 16 within the border 15. The puzzle pieces 12 are adapted for being assembled together on the recessed surface area 16 of the packing frame 11. Each puzzle piece 12 is substantially flat and has opposing first and second major surfaces 12A, 12B. In the case of a gender reveal, one surface 12A, 12B of each piece 12 may be colored blue, while the opposite surface 12A, 12B may be colored pink. The solution key 14 is likewise substantially flat and has opposing first and second major key surfaces 14A, 14B. A first key indicium 18 is located on the first major key surface 14A and a second key indicium 19 located on the second major key surface 14B. In one exemplary embodiment, the first and second key indicia 18, 19 comprise different solid colors (e.g., red and green)—the first key indicium 18 being a narrow red marking located along a single side edge of the solution key 14 on its first major surface 14A, and the second key indicium 19 being a narrow green marking located along a single side edge of the solution key 14 on its second major surface 14B.

Figure 2A:
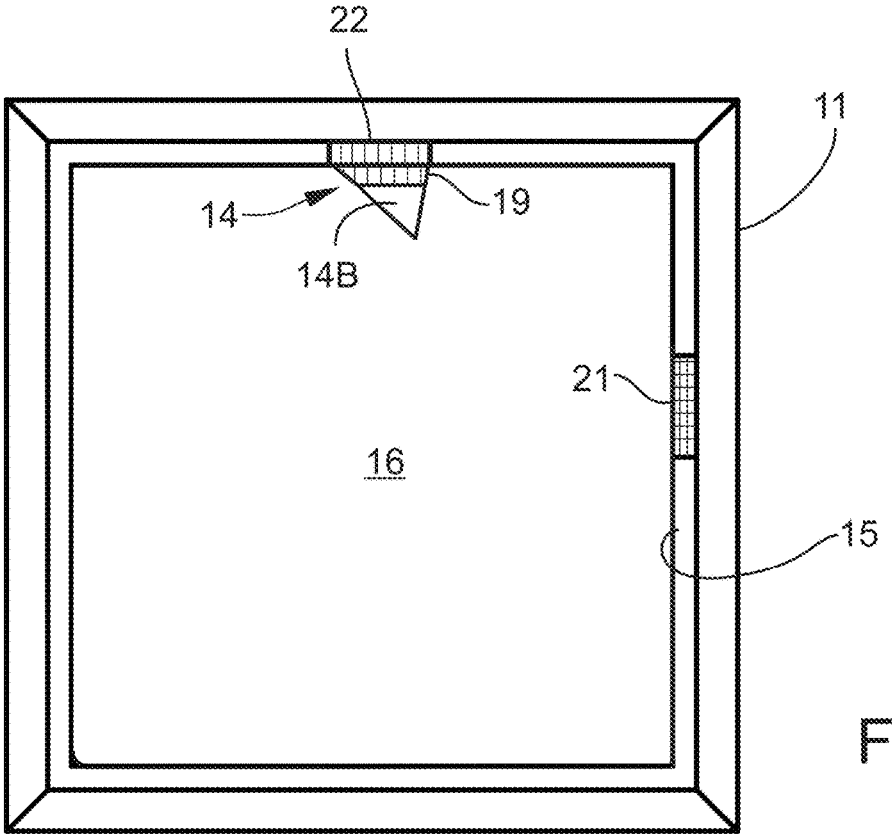
FIGS. 2A and 2B illustrate optional locations of the solution key on the recessed surface area of the packing frame.
Figure 2B:
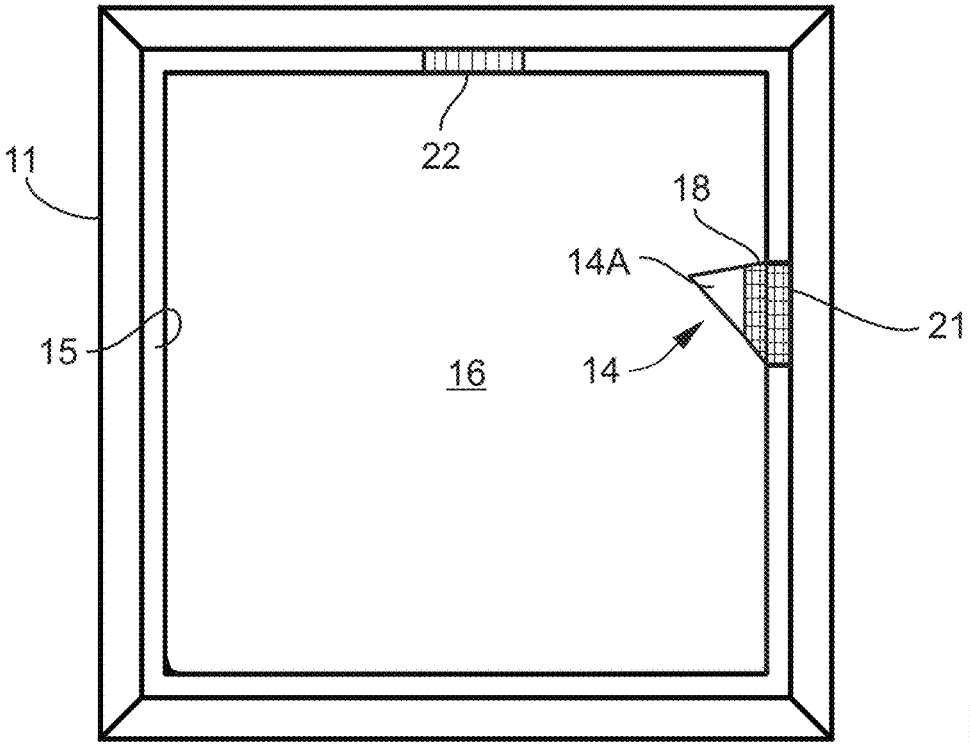
Figure 3:
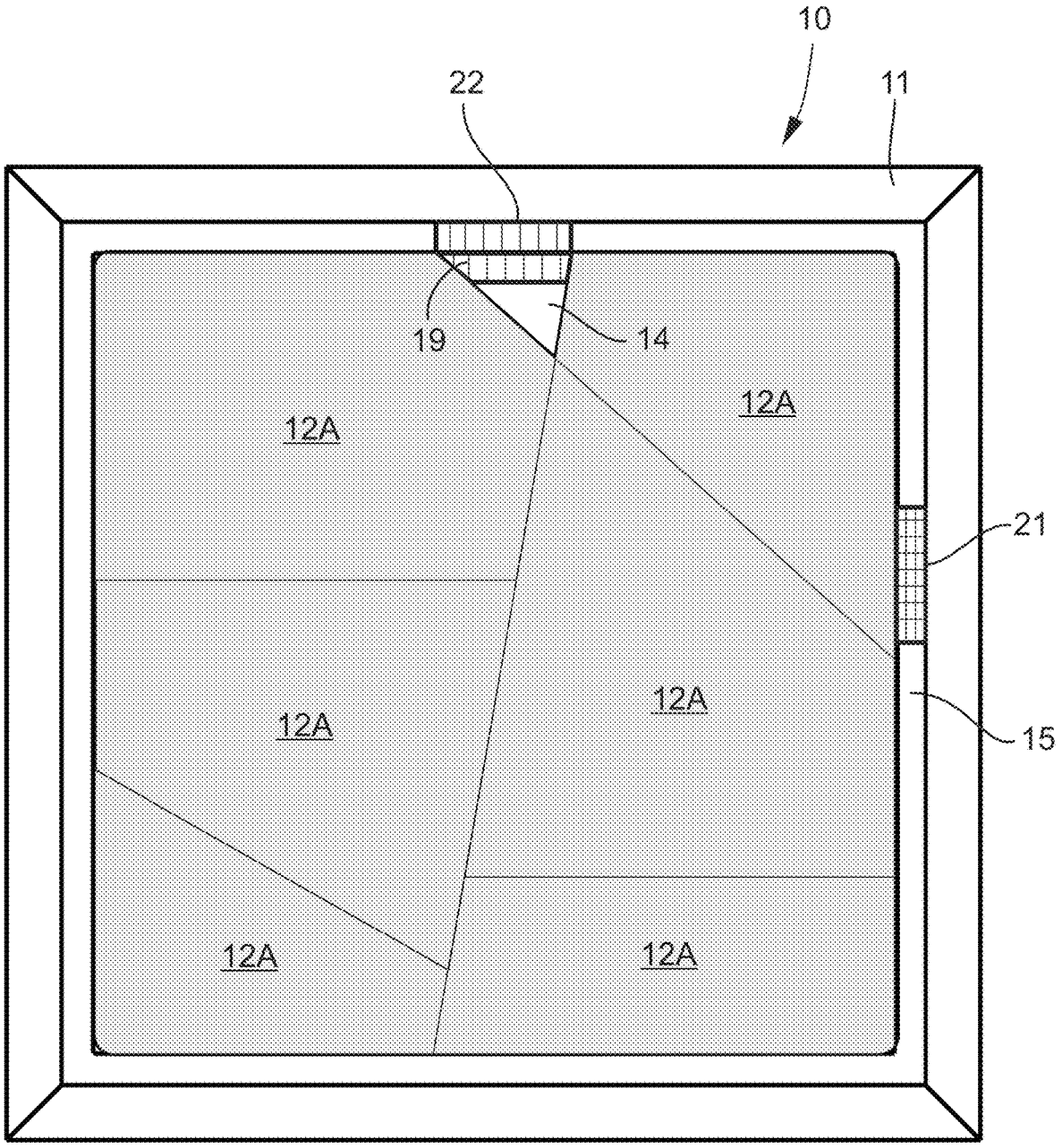
FIG. 3 is a plan view of the tiling puzzle with the puzzle pieces assembled together in the single functional arrangement.

First and second spaced apart frame indicia 21, 22 are located on the border 15 of the packing frame 11 outside of the recessed surface area 16, as best shown in FIGS. 1, 2A and 2B. The first frame indicium 21 may comprise a solid color marking (e.g., red) corresponding to the first key indicium 18 of the solution key 14. The indicia 18, 21 may be substantially identical in color, length, and width. The second frame indicium 22 may comprise a solid color marking (e.g., green) corresponding to the second key indicium 19 of the solution key 14. The indicia 19, 22 may likewise be substantially identical in color, length, and width.

To solve the exemplary tiling puzzle 10, the player first places the solution key 14 on the recessed surface area 16 within the border 15 of the packing frame 11 such that one of the first and second key indicia 18, 19 aligns with a selected one of the first and second frame indicia 21, 22. See FIGS. 2A and 2B. Once an initial placement of the solution key 14 is made, the player attempts to assemble the puzzle pieces 12 together on the recessed surface area 16 in a single functional arrangement with the same major surface 12A, 12B of all puzzle pieces 12 facing up; e.g., either the blue surface 12A of all puzzle pieces facing up or the pink surface 12B of all puzzle pieces facing up. The single functional arrangement is achieved when the solution key 14 and all proper-facing puzzle pieces 12 occupy the entire recessed surface area 16 of the packing frame 11 without gaps or overlaps within the border 15.

The single functional arrangement is determined through a trial and error method of problem solving. If the tiling puzzle 10 cannot be solved with the solution key 14 located at a selected first key point on the surface area 16 of the packing frame 11 (wherein indicia 18, 21 are aligned), the player must flip and relocate the solution key 14 to a second key point on the surface area 16 of the packing frame 11 wherein indicia 19, 22 are aligned. At each location of the solution key 14, the player attempts to achieve the single functional arrangement of puzzle pieces 12 as previously described. In a gender reveal game, for example, all properly assembled puzzle pieces 12 in the single functional arrangement would display a blue color surface 12A announcing a boy or all pieces 12 would display a pink color surface 12B announcing a girl.

In an alternative embodiment (not shown), the solution key of the tiling puzzle may be uniquely shaped to closely fit within a corresponding shaped indent in the recessed surface area or border of the packing frame. Additionally, the packing frame may comprise more than 2 spaced apart indicia for locating the solution key, and the solution key may comprise more than 2 distinct key indicia. In further alternative embodiments, the tiling puzzle may comprise multiple solution keys. The sides of the solution key and puzzle pieces may be cut straight, or may be irregularly cut (like a jigsaw puzzle piece). In the single functional arrangement of the puzzle, the assembled puzzle pieces may reveal a written word or statement, or an image.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A tiling puzzle, comprising:

a packing frame having a raised continuous border and a flat recessed surface area within said border;

a plurality of multi-sided puzzle pieces adapted for being assembled together on the recessed surface area of said packing frame, and each puzzle piece having opposing first and second major surfaces;

first and second spaced apart frame indicia located on the border of said packing frame outside of said recessed surface area;

a multi-sided solution key having opposing first and second major key surfaces, and a first key indicium located on the first major key surface and a second key indicium located on the second major key surface, and wherein the first key indicium corresponds to the first frame indicium and the second key indicium corresponds the second frame indicium;

whereby after properly placing said solution key within said packing frame, said puzzle is solved by assembling said puzzle pieces together on the recessed surface area in a single functional arrangement wherein said solution key and all puzzle pieces occupy the entire recessed surface area within said packing frame without gaps or overlaps.

2. The tiling puzzle according to claim 1, wherein said first and second frame indicia comprise respective markings, each marking having a length corresponding to a length of a side of said solution key.

3. The tiling puzzle according to claim 2, wherein the markings of said frame indicia comprise different first and second colors.

4. The tiling puzzle according to claim 3, wherein the first key indicium is located adjacent a single side of said solution key and comprises a color corresponding to the first color of said frame indicium.

5. The tiling puzzle according to claim 4, wherein the second key indicium is located adjacent a single side of said solution key and comprises a color corresponding to the second color of said frame indicium.

6. The tiling puzzle according to claim 1, wherein the first major surface of each puzzle piece comprises a color pink.

7. The tiling puzzle according to claim 6, wherein the second major surface of each puzzle piece comprises a color blue.

* * * * *